US006041455A

United States Patent [19]

Raffo et al.

[11] Patent Number: 6,041,455

[45] Date of Patent: Mar. 28, 2000

[54] MULTIPURPOSE PLAY YARD AND TRAVEL COT

[76] Inventors: David Melvin Raffo, Hill Farm House, Wicker Lane, Gilden Sutton, Chester, CH3 7EL; Harry Shepherd Thomson, The Old Coach House, Bath Road, Oakhill, Somerset, BA3 5AQ, both of United Kingdom

[21] Appl. No.: 09/166,721

[22] Filed: Oct. 5, 1998

[30] Foreign Application Priority Data

Oct. 7, 1997 [GB] United Kingdom ..... 9721287
Nov. 6, 1997 [GB] United Kingdom ..... 9723511

[51] Int. Cl.[7] ..... A47D 7/00; A47D 7/01

[52] U.S. Cl. ..... 5/99.1; 5/98.1

[58] Field of Search ..... 5/99.1, 98.1, 93.1

[56] References Cited

U.S. PATENT DOCUMENTS 3,886,607 6/1975 Dunn ..... 5/99.1
4,934,025 6/1990 Mariol ..... 5/99.1
4,985,948 1/1991 Mariol ..... 5/99.1
5,560,055 10/1996 Ziegler ..... 5/99.1
5,727,265 3/1998 Ziegler et al. ..... 5/99.1

FOREIGN PATENT DOCUMENTS 0275718 7/1988 European Pat. Off. .
1557841 2/1969 France ..... 5/99.1
822527 10/1959 United Kingdom .

*Primary Examiner*—Alexander Grosz
*Attorney, Agent, or Firm*—Dowell & Dowell, P.C.

[57] ABSTRACT

Apparatus for use in one mode as a cot or play yard and in another mode as a play mat includes a framework which may be used to erect and lower a flexible peripheral wall. A mattress is supported in the apparatus in either mode and is removed during the step of converting from one mode to the other and repositioned. In the play mat mode, the mattress rests on the collapsed framework.

8 Claims, 6 Drawing Sheets

MULTIPURPOSE PLAY YARD AND TRAVEL COT

BACKGROUND OF INVENTION

1. Field of the Invention

This invention relates to play yards which may be collapsed for storage and transportation. In particular, the invention provides a new play yard or travel cot which may be converted into a play mat, and also folded in a convenient way for storage and transportation.

2. Background Art

Play yards or play pens are known from, for example, U.S. Pat. No. 5,560,055, Ziegler, United Kingdom patent No. 822 527, Tigrett, and European patent application No. 275 718A1, Nolet, which may be collapsed for storage. Ziegler discloses a play yard which involves a complex folding action when being collapsed. Although the play yard proposed by Nolet has a trampoline-like floor to allow a child to bounce up and down, its usefulness is limited to a single function. Apparatus of this general type must be constructed to a high standard of safety and reliability and is therefore costly.

SUMMARY OF THE INVENTION

The present invention has for its object the provision of a piece of apparatus which may serve a number of functions, thereby enabling parents to avoid the cost of buying a number of different pieces of equipment. Apparatus in accordance with the invention may serve as a play yard, travel cot and a secure play mat. The apparatus is also adapted to be collapsed in a simple way into a convenient size for storage and transportation.

According to the invention there is provided apparatus for use in one mode as a cot, play pen or play yard and in a second mode as a play mat, comprising a framework having first and second frames connected to each other by struts, whereby in the first mode with the struts extended the first frame is supported at a level above the second frames, and in the second mode with the struts in a collapsed condition the first frame is arranged at substantially the same level as the second frame; the frames holding in place a wall of flexible material bounding the interior space of the apparatus when in the first mode; and a mattress capable of being positioned within the apparatus at the level of the second frames when the apparatus is in its first mode and of being removed and repositioned upon the struts when the same are in their collapsed condition; the frames incorporating hinges to enable the apparatus to be folded when in the second mode for storage and transportation.

DESCRIPTION OF THE PREFERRED EMBODIMENT

Figure 1:
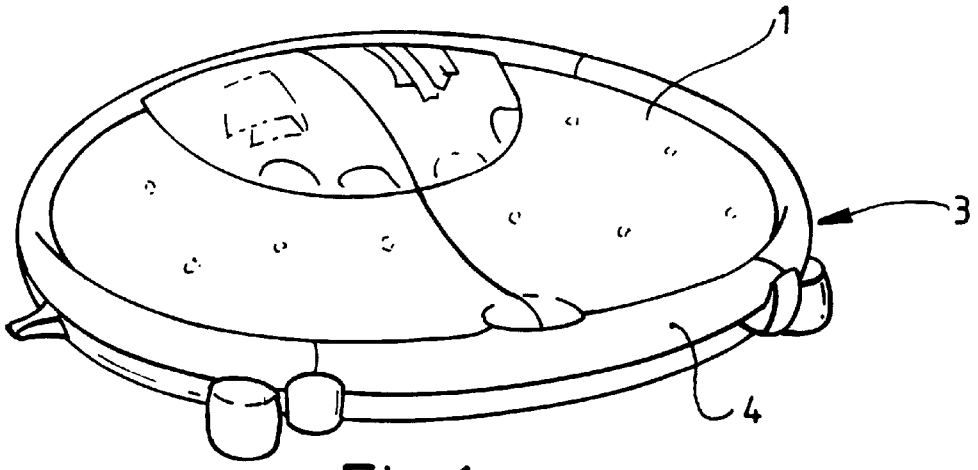
FIG. 1 is a perspective view of the proposed apparatus in the play mat mode.
Figure 2:
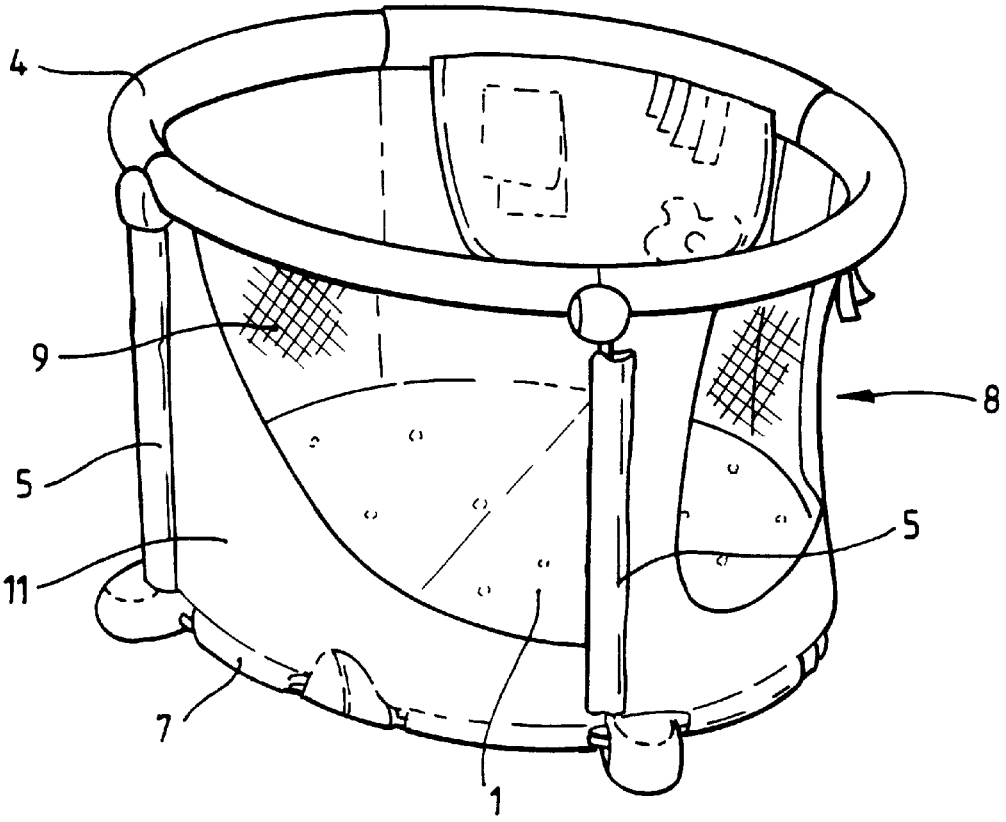
FIG. 2 is a perspective view of the apparatus erected to form a play yard or cot.

Referring to FIGS. 1 and 2, the apparatus proposed herein has a first mode of use as shown in FIG. 1 in which it will serve as a play mat, and a second mode of use as shown in FIG. 2 in which it may serve as a play yard or cot. The apparatus includes a mattress 1 which, in the play mat mode shown in FIG. 1, rests within a generally oval, padded surround 3. The mattress may be removed, the surround erected to form an enclosure, and the mattress replaced to achieve the FIG. 2 mode. When the apparatus is in the play mat mode, the upper portion of the surround 3 is formed by a padded, fabric tube 4. In the erect condition shown in FIG. 2, the tube 4 is supported at a suitable distance above a fabric tube 7. The apparatus includes a support frame work, not visible in FIGS. 1 and 2, which includes an upper, metal, tubular ring which extends through the fabric tube 4, a lower, metal tubular ring which extends through the fabric tube 7, and collapsible support struts extending between the two rings of frame. Preferably there are four spaced-apart struts which may pass through respective vertically extending fabric tubes 5.

The circumferential space between the fabric tubes 4 and 7 is formed by a flexible wall 8 which bounds the interior space of the apparatus in play yard mode. The wall may include fabric mesh portions 9 and opaque fabric portions 11. This combination of materials gives a feeling of space on the one hand and of enclosure and comfort on the other, whilst allowing the child to be seen.

Figure 3:
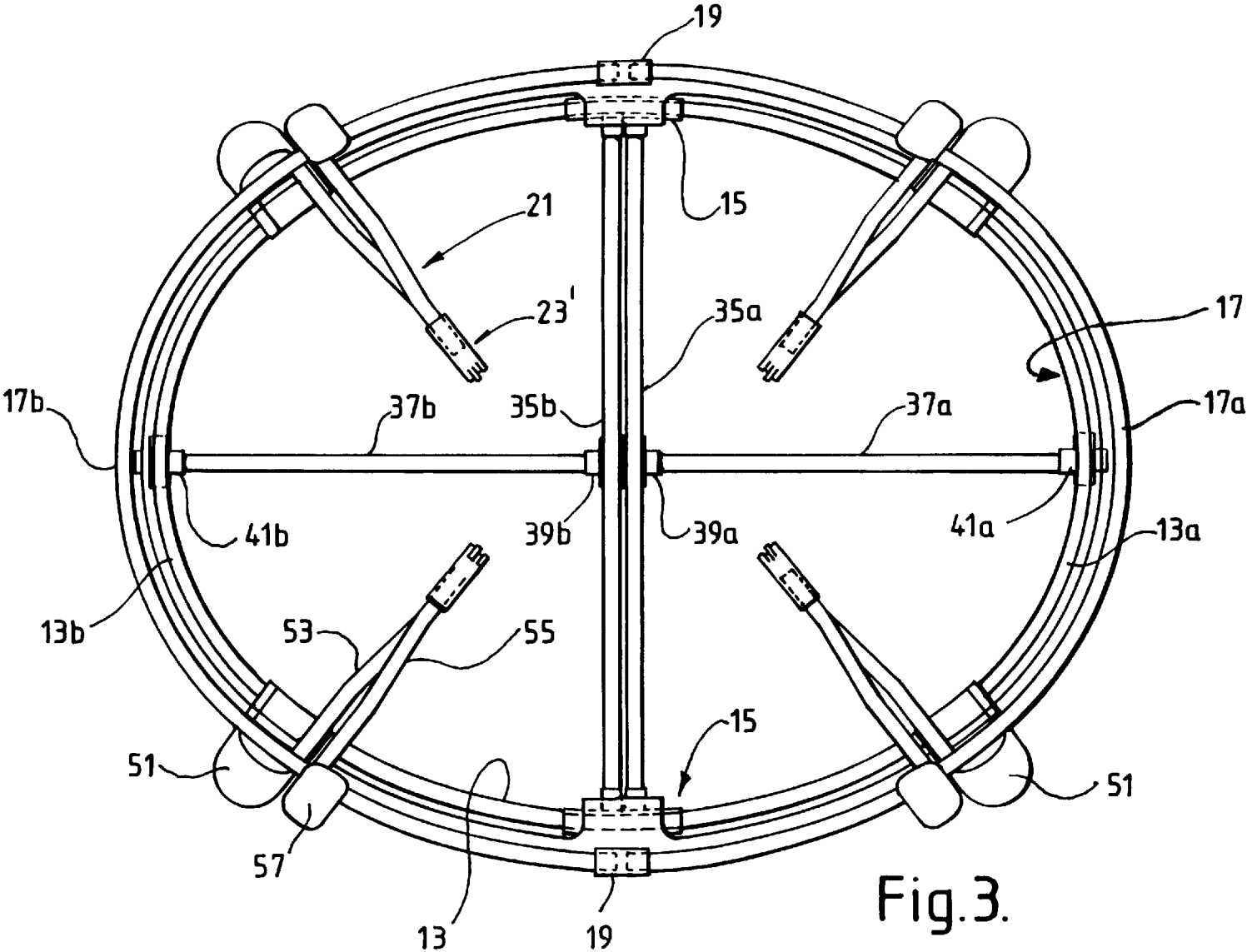
FIG. 3 is a plan view showing the frame work of the apparatus after conversion into a play mat.

The framework of the apparatus is shown in FIGS. 3 to 6, wherein the lower or base ring or frame of the framework is indicated at 13 and the upper ring or frame at 17. The ring 17 is of larger diameter than the ring 13 so that in the play mat mode shown in FIGS. 3, and 5 the ring 17 generally surrounds the ring 13. Each ring or frame is formed from a pair of semi-oval tubes coupled together by means of hinges to allow the apparatus to be folded in half. In FIG. 3, the two halves or sections of the ring 13 are shown at 13*a* and 13*b*, and the two halves or sections of the ring 17 at 17*a* and 17*b*. The semi-oval tubes 13*a*, 13*b* are coupled together by hinges 15, and the semi-oval tubes 17*a*, 17*b* by hinges 19. The upper and lower rings are interconnected by struts 21 articulated to the rings and having a knee-joint 23 to allow the upper ring 17 to be raised and lowered relative to the lower ring 13.

Figure 7:
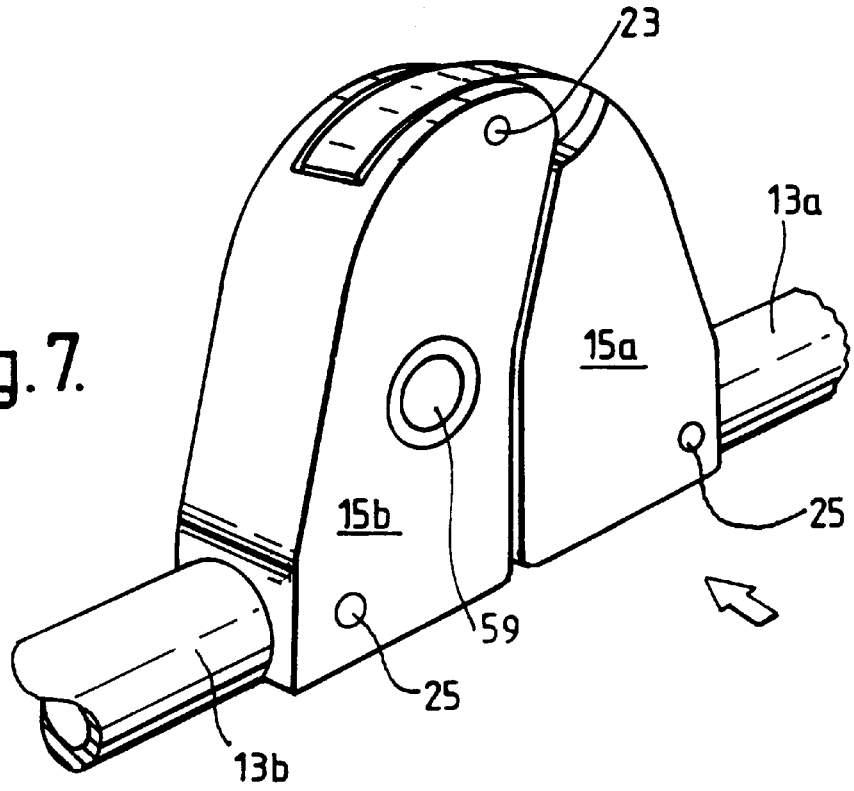
FIG. 7 is a perspective view of a lower hinge.
Figure 8:
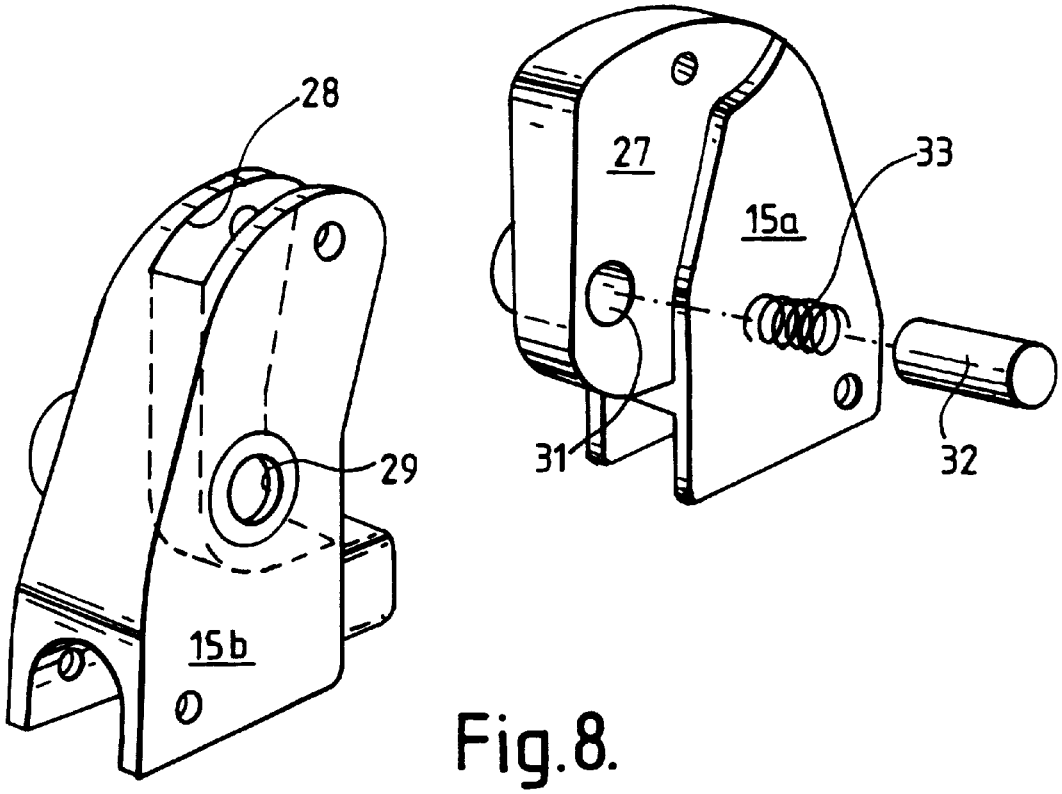
FIG. 8 is a view similar to FIG. 7 but showing the lower hinge with parts exploded.

The hinge 15 is shown in greater detail in FIGS. 7 and 8 and includes two hinge components 15*a*, 15*b* interconnected by a hinge pin 23. Each hinge component has a groove in its under side to receive one of the tubes 13*a*, 13*b* respectively, which are held in place by rivets 25. The hinge component 15*a* has a projecting portion 27 received within a recess 28 in the component 15*b*, preferably with a snap fit. Opening into the recess 28 through the wall of component 15*b* is an opening 29 which aligns with an opening 31 in the projecting portion 27. A push button 32 is retained within the opening 31 and urged by a compression spring 33 into cooperation with the rim of the opening 29 to retain the hinge in the closed position shown in FIG. 7. The tubes 17*a*, 17*b* may be coupled together by means of a simpler hinge 19.

When the hinge 15 is in its closed position as shown in FIG. 7, cooperation of the push button 32 with hole 29 holds the two components rigidly together. When the apparatus is in its play mat mode, either with or without the mattress removed, the push button may be depressed, as indicated by the arrow, to release the latch and allow the structure to be folded from the position shown in FIG. 5 into the position shown in FIG. 6. Extending between the hinge component attached to each U-shaped tube 13*a*, 13*b*, is a respective cross-piece 35*a*, 35*b*, also in the form of tube. At the mid-point of each cross-piece and U-shaped tube are fixed respectively brackets 39*a*, 39*b* and 41*a*, 41*b*, each formed with a socket to receive a bracing piece 37*a*, 37*b*, likewise in the form of a tube.

The tubes 13*a*, 35*a* and 37*a* on the one hand and 13*b*, 35*b* and 37*b* on the other form two hinged base structures.

Figure 9:
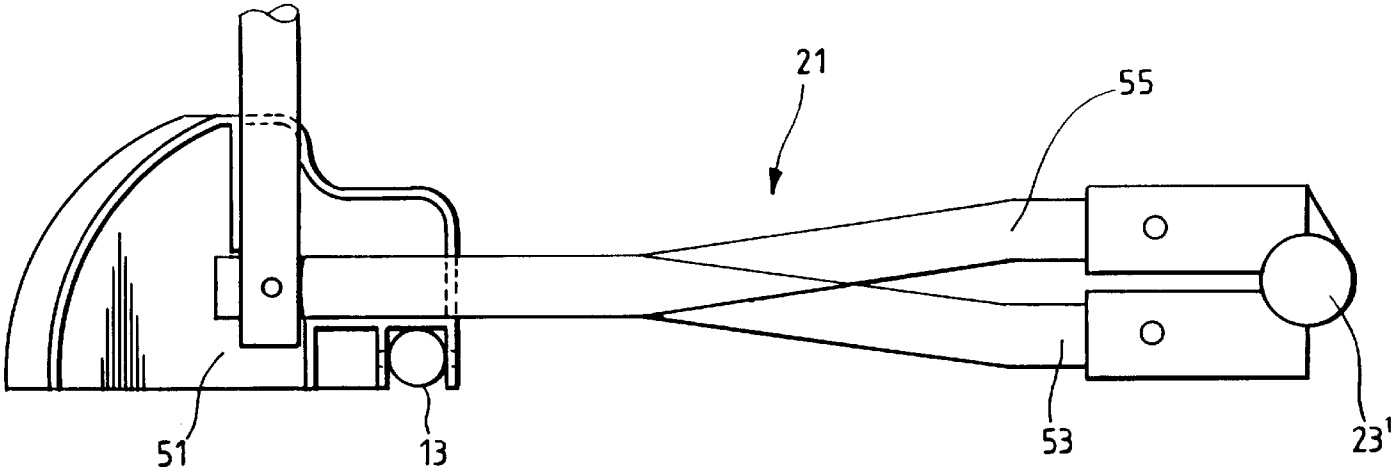
FIG. 9 is a partly cut-away elevation view of a support strut in its lowered condition.
Figure 10:
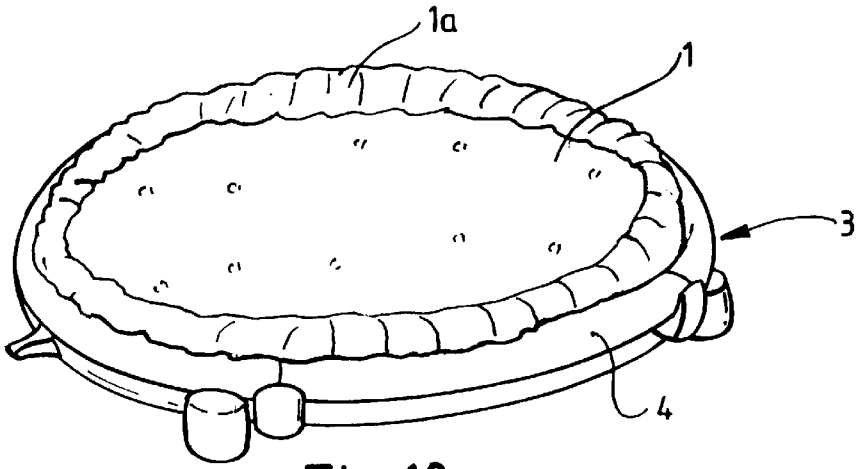
FIG. 10 is a view similar to FIG. 1 of a modification.

Each of the lower U-shaped tubes 13*a*, 13*b* is supported by a pair of feet or pods 51 having a channel into which the tube 13*a* or 13*b* fits, as shown in FIG. 10. Each of the support struts 21 includes a lower section 53 and an upper section 55 articulated together by hinge joint 23'. Each of the strut sections 53, 55 is cranked both in the vertical and horizontal planes so that when the struts are lowered as shown in FIGS. 3 and 9, the upper section extends parallel to and in the same horizontal plane as the lower section but spaced therefrom.

Figure 4:
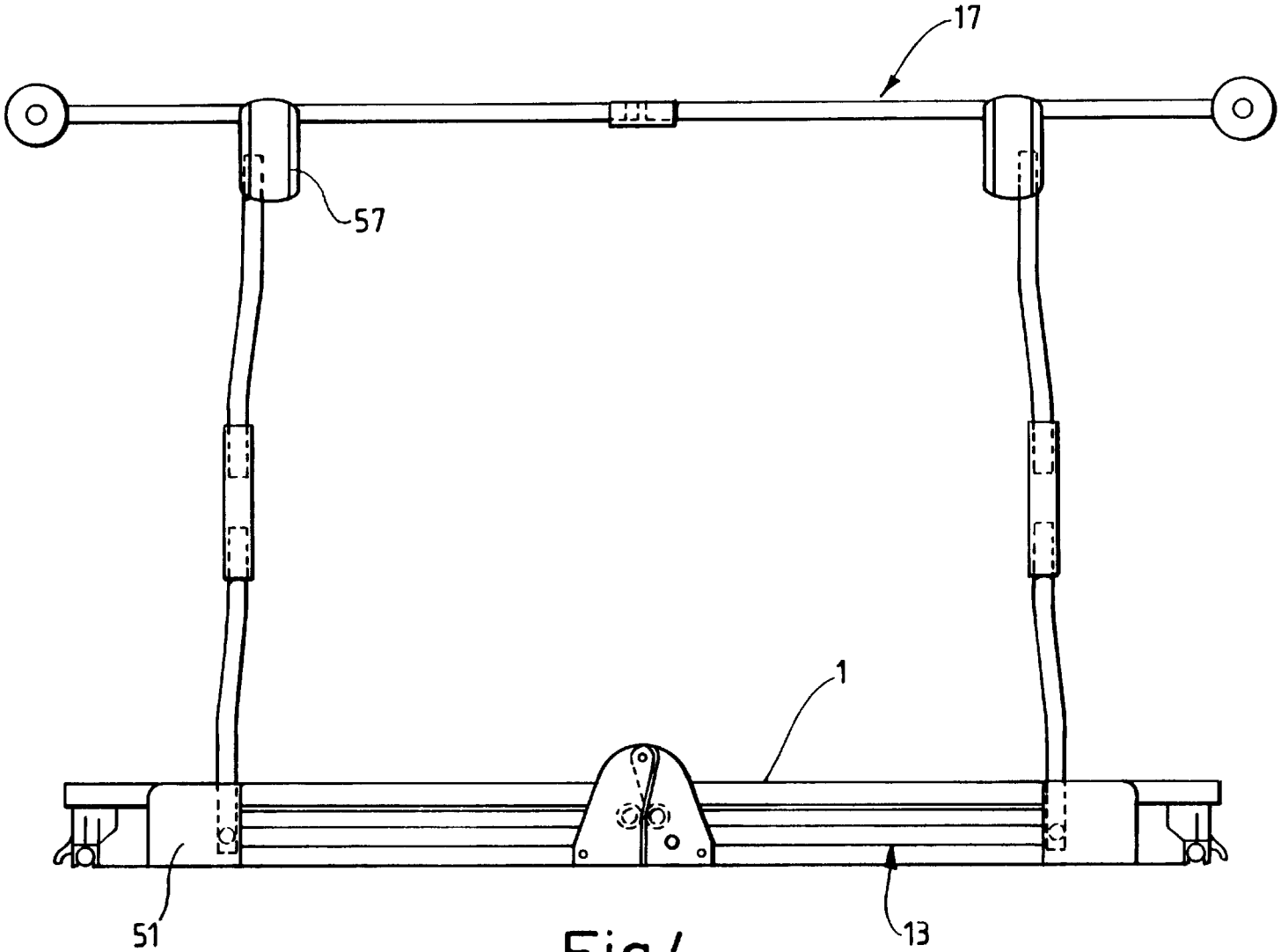
FIG. 4 is a side view of the framework in its erected condition.
Figure 6:
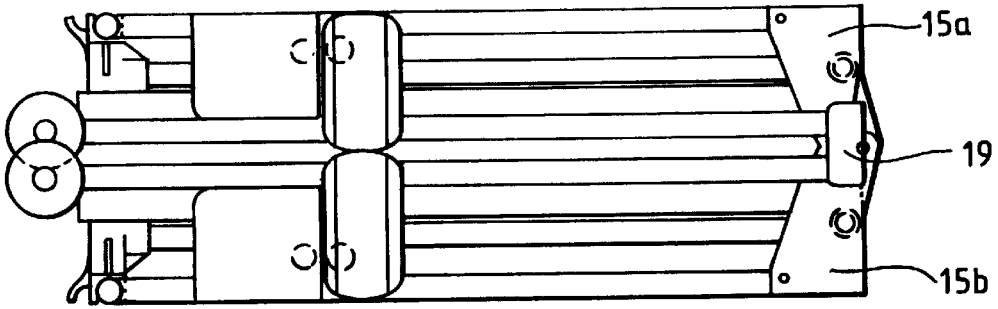
FIG. 6 is a view corresponding to FIG. 5 but with the framework of the apparatus folded for storage.
Figure 5:
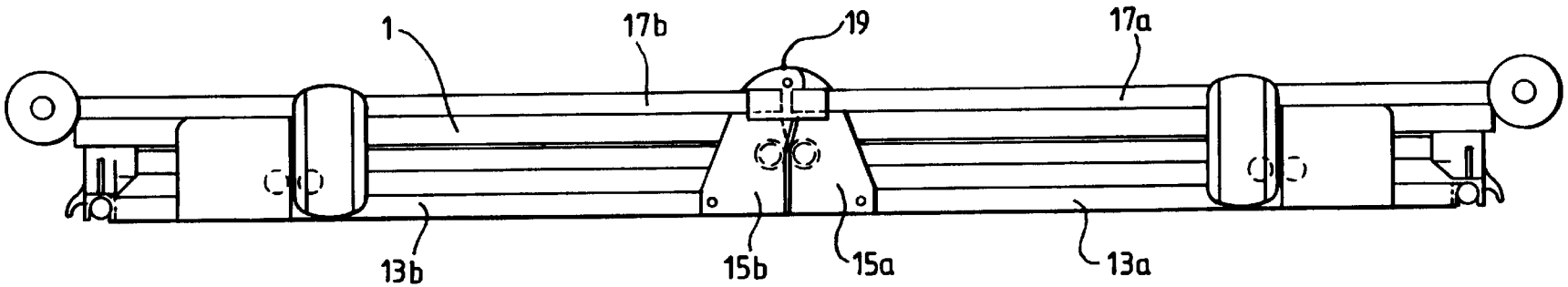
FIG. 5 is a side view of the framework in the position it occupies when the apparatus is in use as a play mat shown in FIG. 3.

As shown in FIGS. 3 and 4, the upper section 55 of each strut is articulated at its upper end to an upper pod 57 fastened to the upper rail.

The hinge 23' between the upper and lower sections of each support strut is provided with a locking mechanism similar to that of hinge 15 which may also be released by pressing a push button such as 59 used with hinge 15.

It will be appreciated from the foregoing that the locking mechanism associated with each hinge 23 ensures that the apparatus may not be collapsed accidentally or by a child because the buttons for interlocking the sections of the support struts are inaccessible from within the structure. Similarly, the locking mechanism associated with each hinge 15 ensures that the collapsed apparatus may not be accidentally folded in half for storage. Although the push buttons used to operate the locking mechanisms are concealed within the fabric cover, they may easily be felt through the fabric.

In a modified apparatus, shown in FIG. 10, the mattress is bounded by a raised, padded bumper la which in the collapsed apparatus rests against the lowered, upper ring. The padding in the tube 4 may therefore be removed or eliminated.

We claim:

1. An apparatus having a first mode of use as a play pen and a second mode of use as a play mat, said apparatus comprising:

a) a flexible wall (8) bounding an interior space in said first mode of use;

b) a framework comprising;

(i) a pair of base frame sections (13*a*, 35*a*, 37*a* and 13*b*, 35*b* and 37*b*) interconnected by first hinges (15), the frame sections bounding a lower extremity of the interior space, the flexible wall having its lower edge retained by the base frame sections, (ii) a pair of upper frame sections (17*a*, 17*b*) interconnected by second hinges (19), the upper frame sections bounding an upper extremity of the interior space and the flexible wall having its upper edge supported by the upper frame sections when in said first mode of use, (iii) a plurality of struts (21) each articulated at one end to the base frame sections (13*a*, 13*b*) and at its other end to the upper frame sections (17*a*,17*b*), each strut having an articulated joint along its length, each strut having:

an extended condition in the first mode of use in which the upper frame sections are supported above the base frame sections and the flexible wall is held erect;

an alternate collapsed condition in the second mode of use in which the upper frame sections occupy a position adjacent the base frame sections and the struts project into the interior space;

c) a mattress (1) supported on the base frame sections within the flexible wall in the first mode of use, the mattress being removable to permit the struts to be collapsed, the mattress being repositionable on the base frame sections and struts in the second mode of use; and d) the apparatus being foldable about the first and second hinges (15,19) to position the two base frame sections and the two upper frame sections in parallel relationship one with another for storage or transportation.

2. An apparatus as claimed in claim 1, wherein the two base frame sections (13*a*,13*b*) and the two upper frame sections (17*a*,17*b*) each form a closed oval ring.

3. An apparatus as claimed in claim 1, wherein the first hinges (15) connecting the upper frame sections incorporate latching mechanisms to prevent the apparatus from folding except following release of the mechanisms.

4. An apparatus as claimed in claim 3, wherein the apparatus is foldable into semi-oval form.

5. An apparatus as claimed in claim 1, wherein the pair of base frame sections comprise a pair of inter-articulated semi-oval tubular frame members (13*a*, 13*b*) each secured at its ends to the first hinges (15), cross-members (35*a*,35*b*) extending between the first hinges, and bracing members (37*a*,37*b*) extending between the cross-member and a mid-point of each semi-oval member.

6. An apparatus as claimed in claim 1, including means defining a padded surround (4) to the mattress.

7. An apparatus as claimed in claim 6, wherein the means defining a padded surround to the mattress is a raised bumper attached to a periphery of the mattress.

8. An apparatus having a first mode of use as a play pen and a second mode of use as a play mat, said apparatus comprising:

a) a flexible wall (8) bounding an oval interior space of the apparatus in said first mode of use;

b) a framework comprising;

(i) an oval base frame (13) defined by a pair of base frame sections each including a semi-oval tube (13*a*,13*b*) interconnected by first hinges (15) each having two hinge components incorporating latching mechanisms, the flexible wall having its lower edge retained by the base frame, said base frame further including cross-members (35*a*,35*b*) extending between the first hinges and bracing members (37*a*,37*b*) extending between the cross-members and the oval tubes, (ii) an upper oval frame (17) formed from a pair of semi-oval tubes (17*a*,17*b*) interconnected by second hinges (19), the flexible wall having its upper edge supported by the upper frame when in said first mode of use, the upper frame being provided with a padded surround, (iii) a plurality of struts (21) each articulated at one end to the base frame (13) and at its other end to the upper frame (17), each strut having two component parts interconnected by an articulated joint along its length, the struts having:

an extended condition in the first mode of use in which the upper frame (17) is supported above the base frame (13) and the flexible wall is held erect;

an alternate collapsed condition in the second mode of use in which the upper frame occupies a position generally at the level of, and externally of, the base frame, and the struts project into the interior space at said level with the two component parts of each strut being parallel to each other, c) a mattress (1) supported on the base frame within the flexible wall in the first mode of use, the mattress being removable to permit the struts to be collapsed, the mattress being repositionable on the base frame and struts in the second mode of use; and d) the apparatus being foldable about the first and second hinges (15,19) with the latching mechanisms unlatched to position the two parts of the base frame and the two parts of the upper frame in parallel relationship one with another for storage or transportation.

* * * * *